US007967033B2

(12) United States Patent
Barrett

(10) Patent No.: US 7,967,033 B2
(45) Date of Patent: Jun. 28, 2011

(54) PAPERMAKER'S FABRIC TO DEVELOP CALIPER AND TOPOGRAPHY IN PAPER PRODUCTS

(75) Inventor: Rex Barrett, Neenah, WI (US)

(73) Assignee: AstenJohnson, Inc., Charleston, SC (US)

( * ) Notice: Subject to any disclaimer, the term of this patent is extended or adjusted under 35 U.S.C. 154(b) by 532 days.

(21) Appl. No.: 12/237,480

(22) Filed: Sep. 25, 2008

(65) Prior Publication Data

US 2009/0078388 A1 Mar. 26, 2009

Related U.S. Application Data

(60) Provisional application No. 60/974,890, filed on Sep. 25, 2007.

(51) Int. Cl.
*D03D 3/04* (2006.01)
*D21F 7/08* (2006.01)
*D03D 25/00* (2006.01)

(52) U.S. Cl. ..... 139/383 A; 139/383 R; 162/358.2

(58) Field of Classification Search ..... 162/348, 162/358.1, 358.2, 900, 902, 903, 904; 139/383 R, 139/383 A, 383 AA, 408, 411, 412, 413, 139/414

See application file for complete search history.

(56) References Cited

U.S. PATENT DOCUMENTS 5,456,293 A 10/1995 Ostermayer et al.
5,490,543 A 2/1996 Fujisawa
5,542,455 A 8/1996 Ostermayer et al.
5,544,678 A * 8/1996 Barrett ..... 139/383 A
5,826,627 A * 10/1998 Seabrook et al. ..... 139/383 A
5,839,479 A 11/1998 Gulya et al.
7,059,359 B2 6/2006 Quigley et al.
7,108,020 B2 9/2006 Stone (Continued)

FOREIGN PATENT DOCUMENTS

CN 1777719 5/2006

OTHER PUBLICATIONS

R. Danby and J. Perrault, Weaves of Papermaking Wires and Forming Fabrics, May 2005, pp. 1-18, Pulp and Paper Technical Association of Canada.

*Primary Examiner* — Bobby H Muromoto, Jr.
(74) *Attorney, Agent, or Firm* — Volpe and Koenig, P.C.

(57) ABSTRACT

A papermaker's fabric including at least one system of warp yarns interwoven with at least first and second systems of weft yarns, with the weft yarns of the first system of weft yarns having a vertical dimension that is greater than a vertical dimension of the weft yarns of the second system. The fabric has a papermaking surface and a machine side surface, and in the papermaking surface, the yarns of the first system of weft yarns are interwoven with the warp yarns to provide groups of four weft yarn floats which form four corners of a box shape, the yarns of the second system of weft yarns are interwoven with the warp yarns so as to pass through the bottom of the box shape, and further provide support areas in pockets located adjacent to the box shapes, and at least one yarn from the second system of weft yarns interweaves with the warp yarns to occupy space in a center plane of the fabric so as to restrict or retard drainage and thereby increase a center plane resistance of the fabric.

12 Claims, 4 Drawing Sheets

U.S. PATENT DOCUMENTS

| | | | | |
|---|---|---|---|---|
| 7,445,032 | B2 * | 11/2008 | Barrett et al. | 139/383 A |
| 7,493,923 | B2 * | 2/2009 | Barrett et al. | 139/383 A |
| 2004/0094223 | A1 * | 5/2004 | Johnson et al. | 139/383 A |
| 2005/0067039 | A1 | 3/2005 | Lafond et al. | |
| 2006/0249220 | A1 * | 11/2006 | Barrett et al. | 139/383 A |
| 2007/0209770 | A1 * | 9/2007 | Barrett et al. | 162/358.2 |
| 2008/0035230 | A1 * | 2/2008 | Danby et al. | 139/383 A |
| 2008/0169040 | A1 * | 7/2008 | Barrett | 139/383 A |
| 2009/0068909 | A1 * | 3/2009 | Quigley | 442/205 |
| 2010/0236742 | A1 * | 9/2010 | Rigby et al. | 162/289 |

* cited by examiner

50

| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|
| 1′ | | | 3 | | | 6 | | | 9 | | | 12 | | | | | | | | | | | | |
| 2′ | 1 | 2 | 3 | 4 | 5 | 6 | 7 | 8 | 9 | 10 | 11 | 12 | 13 | | 15 | 16 | 17 | | 19 | 20 | 21 | | 23 | 24 |
| 3′ | 1 | | | 4 | 5 | 6 | 7 | 8 | 9 | 10 | | | | | | | | | | | | | | |
| 4′ | 1 | 2 | 3 | 4 | | | 7 | | | 10 | 11 | 12 | 13 | | | | | | | | | | | |
| 5′ | 1 | 2 | 3 | 4 | 5 | 6 | 7 | 8 | 9 | 10 | 11 | 12 | 13 | 14 | 15 | | 17 | 18 | 19 | | 21 | 22 | 23 | |
| 6′ | | 2 | | | 5 | | | 8 | | | 11 | | | | | | | | | | | | | |
| 7′ | | | 3 | | | 6 | | | 9 | | | 12 | | | | | | | | | | | | |
| 8′ | 1 | 2 | 3 | 4 | 5 | 6 | 7 | 8 | 9 | 10 | 11 | 12 | 13 | 14 | | 16 | 17 | 18 | | 20 | 21 | 22 | | 24 |
| 9′ | 1 | 2 | 3 | 4 | | | 7 | | | 10 | 11 | 12 | | | | | | | | | | | | 24 |
| 10′ | | | 3 | | | 6 | | | 9 | | | 12 | | | | | | | | | | | | |
| 11′ | 1 | 2 | 3 | 4 | 5 | 6 | 7 | 8 | 9 | 10 | 11 | 12 | | 14 | 15 | 16 | | 18 | 19 | 20 | | 22 | 23 | 24 |
| 12′ | 1 | 2 | 3 | 4 | | | 7 | | | 10 | 11 | 12 | | | | | | | | | | | | |
| 13′ | 1 | | | 4 | 5 | 6 | 7 | 8 | 9 | 10 | | | | | | | | | | 20 | | | | |
| 14′ | 1 | 2 | 3 | 4 | 5 | 6 | 7 | 8 | 9 | 10 | 11 | 12 | 13 | | 15 | 16 | 17 | | 19 | 20 | 21 | | 23 | 24 |
| 15′ | | 2 | | | 5 | | | 8 | | | 11 | | | | | | | | | | | | | |
| 16′ | | | 3 | | | 6 | | | 9 | | | 12 | | | | | | | | | | | | |
| 17′ | 1 | 2 | 3 | 4 | 5 | 6 | 7 | 8 | 9 | 10 | 11 | 12 | 13 | 14 | 15 | | 17 | 18 | 19 | | 21 | 22 | 23 | |
| 18′ | 1 | | | 4 | 5 | 6 | 7 | 8 | 9 | 10 | | | | | | | | 18 | | | | | | |
| 19′ | | | 3 | | | 6 | | | 9 | | | 12 | | | | | | | | | | | | |
| 20′ | 1 | 2 | 3 | 4 | 5 | 6 | 7 | 8 | 9 | 10 | 11 | 12 | 13 | 14 | | 16 | 17 | 18 | | 20 | 21 | 22 | | 24 |
| 21′ | 1 | | | 4 | 5 | 6 | 7 | 8 | 9 | 10 | | | | | | | | | | | | | | |
| 22′ | 1 | 2 | 3 | 4 | | | 7 | | | 10 | 11 | 12 | | 14 | | | | | | | | | | |
| 23′ | 1 | 2 | 3 | 4 | 5 | 6 | 7 | 8 | 9 | 10 | 11 | 12 | | 14 | 15 | 16 | | 18 | 19 | 20 | | 22 | 23 | 24 |
| 24′ | | 2 | | | 5 | | | 8 | | | 11 | | | | | | | | | | | | | |
| 25′ | | | 3 | | | 6 | | | 9 | | | 12 | | | | | | | | | | | | |
| 26′ | 1 | 2 | 3 | 4 | 5 | 6 | 7 | 8 | 9 | 10 | 11 | 12 | 13 | | 15 | 16 | 17 | | 19 | 20 | 21 | | 23 | 24 |
| 27′ | 1 | 2 | 3 | 4 | | | 7 | | | 10 | 11 | 12 | | | | | | | | | | | 23 | |
| 28′ | | | 3 | | | 6 | | | 9 | | | 12 | | | | | | | | | | | | |
| 29′ | 1 | 2 | 3 | 4 | 5 | 6 | 7 | 8 | 9 | 10 | 11 | 12 | 13 | 14 | 15 | | 17 | 18 | 19 | | 21 | 22 | 23 | |
| 30′ | 1 | 2 | 3 | 4 | | | 7 | | | 10 | 11 | 12 | | | | | | | | | | | | |
| 31′ | 1 | | | 4 | 5 | 6 | 7 | 8 | 9 | 10 | | | | | | | 17 | | | | | | | |
| 32′ | 1 | 2 | 3 | 4 | 5 | 6 | 7 | 8 | 9 | 10 | 11 | 12 | 13 | 14 | | 16 | 17 | 18 | | 20 | 21 | 22 | | 24 |
| 33′ | | 2 | | | 5 | | | 8 | | | 11 | | | | | | | | | | | | | |
| 34′ | | | 3 | | | 6 | | | 9 | | | 12 | | | | | | | | | | | | |
| 35′ | 1 | 2 | 3 | 4 | 5 | 6 | 7 | 8 | 9 | 10 | 11 | 12 | | 14 | 15 | 16 | | 18 | 19 | 20 | | 22 | 23 | 24 |
| 36′ | 1 | | | 4 | 5 | 6 | 7 | 8 | 9 | 10 | | | | | | | | | 19 | | | | | |

FIG. 3

PAPERMAKER'S FABRIC TO DEVELOP CALIPER AND TOPOGRAPHY IN PAPER PRODUCTS

FIELD OF THE INVENTION

The present invention concerns papermaker's fabrics which can be used to develop and augment caliper and topography in paper products formed thereon. It is particularly concerned with such fabrics which impart caliper and topography in the paper product during formation of the sheet, and also those fabrics that are used to convey the sheet through a through-air drying (TAD) unit.

BACKGROUND OF THE INVENTION

It has been known to provide a forming fabric in which so-called BE, or bulk-enhancing, yarns are periodically inserted into the PS weave; these yarns may be inserted at regular or irregular intervals and will account for from 10% to 50% of the PS weft yarns. The yarns have a vertical dimension that is at least 1.25 times greater than that of the "regular" weft yarns in the PS of the fabric. Two or more sets of these BE yarns can be used. The fabric construction may include at least one set of machine direction yarns, at least one set of cross-machine direction yarns, and an array of BE yarns. Such fabrics may have a multilayer construction and include pairs of intrinsic weft binder yarns, or may be a multilayer fabric whose warp yarns are ordered as triplet sets.

Multi-layer tissue forming fabrics are also known which are constructed to impart bulk in paper products formed thereon by providing a topographical difference between at least two yarns in the PS of the fabric. By using at least two different diameter, size or shape weft yarns positioned at the same contour in the forming surface it is possible to form pocket areas to increase surface area, develop topography and impart other desirable properties in tissue or towel products, for example.

Other papermaker's fabrics containing yarns of differing sizes in the papermaking surface are also known for various purposes with respect to increasing the life and runability of papermaker's fabrics on papermaking machines.

Sheet caliper and topography, thus bulk and absorbency, are highly desirable features of tissue and towel products. Paper machine clothing manufacturers strive to design fabrics which introduce differences in elevation (topography) in the papermaking surface of the fabric as it is these elevation differences which create pockets and protrusions in the paper product that in turn cause differences in fiber density in the sheet and increase its surface area. These factors amongst a number of others will help to provide an absorbent paper product.

Prior art fabrics currently in use have met with varying degrees of success. It has been recognized by the present inventor that larger pockets and protrusions in the paper product are more desirable (from a bulk and absorbency point of view) than a greater number of relatively smaller pockets and protrusions. It is also well known that sheet uniformity (i.e. a relatively even distribution of papermaking fibers) will provide a paper product with higher strength and other desirable physical properties. A problem common to prior art fabrics is that, in order to provide the desired bulking effect in the sheet, the fabric weave has been engineered so that it has relatively more "open" and "closed" areas; this leads to uneven drainage of the sheet and consequently uneven formation.

The present invention has noted these deficiencies and seeks to provide a fabric which is capable of producing larger pockets and thus develop caliper and augment topography and surface area at equal basis weights in the sheet product than has previously been possible, while maintaining good sheet uniformity and strength by retarding straight-through drainage in the fabric.

SUMMARY OF THE INVENTION

The invention provides papermaker's fabrics which impart and develop both caliper and topography in absorbent paper products such as towel or tissue which are formed or conveyed upon them. The fabric includes one or more systems of warp yarns and at least first and second systems of weft yarns interwoven together to provide a fabric having a paper side surface upon which the paper product is formed and/or conveyed, and a machine side surface which, when in use, is in moving contact with the supporting elements of the papermaking machine. The at least first and second systems of weft yarns have yarns of differing sizes, and each is woven according to differing patterns in the paper side surface. The yarns of the first weft system have a vertical dimension which is greater than that of the yarns of the second weft system; and they are interwoven with the warp yarns so as to form pairs of adjacent fiber support yarn knuckles on the paper side surface. The length of each knuckle is determined by the number of warp yarns with which the weft yarns are interwoven and will generally be between 1 and 4 (but other numbers are possible). Each pair of knuckles is separated from the next pair of knuckles on the same weft yarn (i.e. in the CD) preferably by the same number of warp yarns used to form the first knuckle pair. Yarns from the second weft yarn system are located between each successive weft of the first yarn system (i.e. in the MD), with the number of such second weft system yarns preferably ranging from at least one to about 6. The pair of fiber support weft yarn knuckles on a first weft system yarn, separated from the next adjacent first weft system yarn by at least one second weft system yarn, along with the pair of fiber support weft yarn knuckles of the next adjacent first system yarn, form a grouping of fiber support knuckles arranged with a 4-cornered box shape. These four yarn knuckles create low fiber density protrusions in paper products formed on or conveyed by the fabric. A depression or pocket is formed in the fabric in between the four corners, as well as between the boxes.

The pockets create relatively higher fiber density depressions in the sheet which, together with the protrusions, contribute to its overall caliper, surface area and topography. The second set of weft yarns includes pocket yarns interwoven with the warp yarns to form both the "bottom" of the boxes as well as the "bottom" of adjacent pockets located between the boxes; the pocket yarns assist to retain the papermaking fibers on the fabric surface so that they do not become entrapped in, or pass through the fabric itself. The pocket yarns are not interwoven into the machine side surface of the fabric and thus also serve to contribute to the center plane resistance of the fabric, which retards drainage and in turn helps to increase sheet uniformity. The number of pocket yarns between adjacent boxes, as well as the number of pocket yarns within each individual box, can be varied so that box size and spacing can be modified in response to papermaking requirements.

The basic design of the invention (box and pocket) can be used in any known fabric construction including single, double and triple layer fabrics, such as various fabrics described in "Weaves of Papermaking Wires and Forming Fabrics," PAPTAC [Pulp & Paper Technical Association of Canada] Data Sheet G-18, revised May 2005, but they are believed to be most effective when used in so-called SSB and warp-tie structures, non-limiting examples of which are described on U.S. Pat. No. 5,826,627; U.S. Pat. No. 7,108,020 and U.S. 2008/0035230. Other fabric structures are known and can also be used.

Paper products made using the fabrics of the present invention exhibit greater uniformity and higher bulk than similar products made using fabrics constructed according to the prior art.

In a preferred embodiment, the yarns of the second system of weft yarns have a vertical dimension that is less than that of the yarns in the first system. The disclosed arrangement of the first and second weft yarn systems in the present invention is applicable to any fabric construction and will assist in developing and augmenting caliper, topography and uniformity in paper products formed using the fabric. Preferably, the ratio of the vertical dimension of the yarns of the first weft system, as measured in a direction substantially perpendicular to the paper side surface of the fabric, to those of the second weft system, is at least 1.25:1.

BRIEF DESCRIPTION OF THE DRAWINGS

The foregoing Summary as well as the Detailed Description that follows of the preferred embodiments of the invention will be better understood when read in conjunction with the appended drawings. In the drawings:

FIG. 3 is a weave diagram of the complete fabric whose paper side surface is shown in FIG. 1 and 2;

DETAILED DESCRIPTION OF THE PREFERRED EMBODIMENTS

Figure 1:
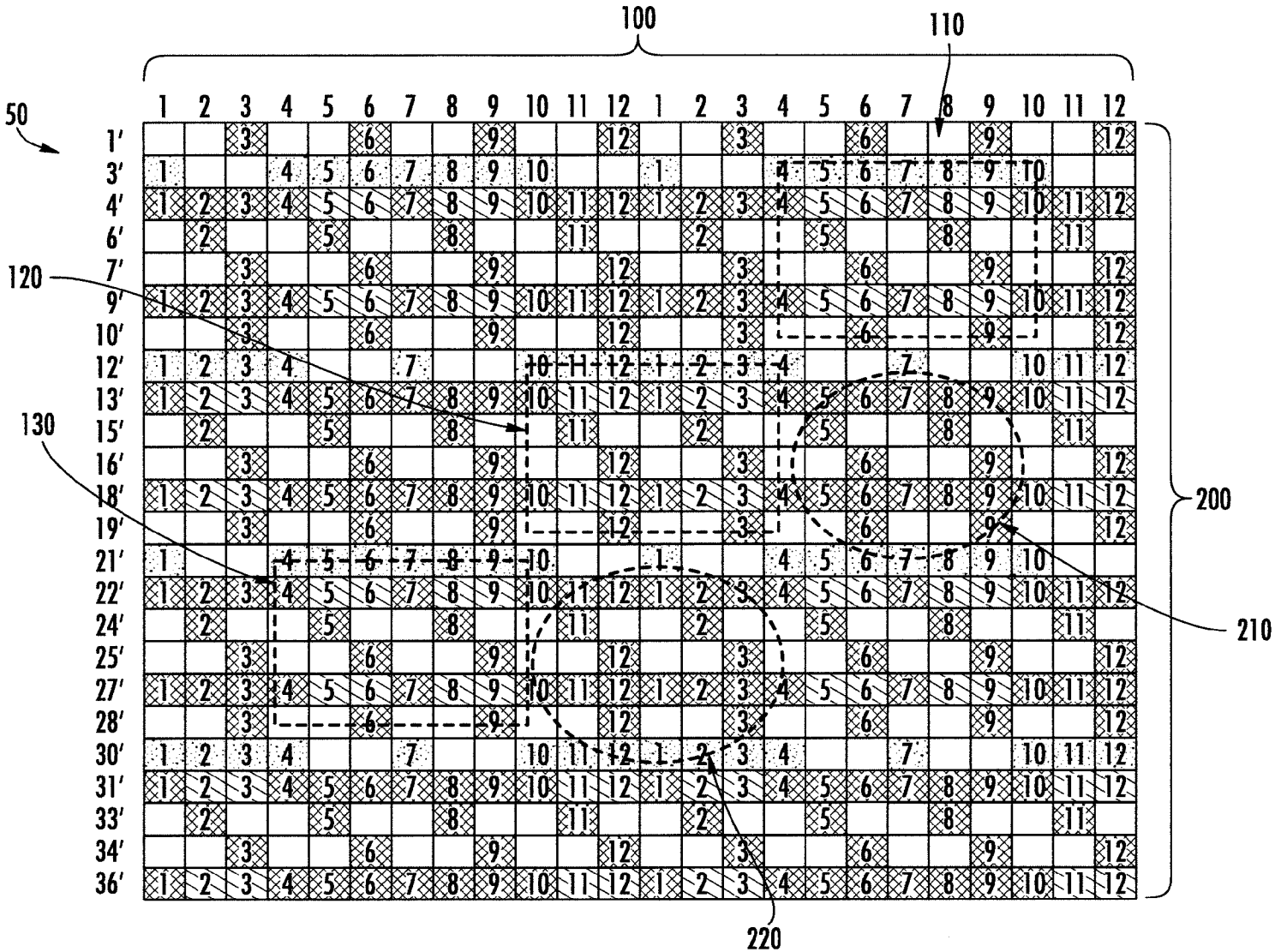
FIG. 1 is a weave diagram of the paper side surface only of a composite fabric according to a first embodiment of the present invention.

Certain terminology is used in the following description for convenience only and is not considered limiting. Words such as "front", "back", "top" and "bottom" designate directions in the drawings to which reference is made. This terminology includes the words specifically noted above, derivatives thereof and words of similar import. Additionally, the terms "a" and "one" are defined as including one or more of the referenced item unless specifically noted.

The following definitions will also apply to the terms used herein:

Bulk—the compactness property of a sheet in relation to its weight (whose value decreases as the compactness increases) and is the volume of a unit mass of fiber, typically expressed in grams per cubic centimeter (g/cc). In paper mills, it is measured as the thickness of a pile of a specified number of sheets under a specified pressure. (paraphrased from: Lavigne, John R. *Pulp & Paper Dictionary*. San Francisco, Calif.: Miller Freeman, 1986, pp. 120).

Caliper—the maximum thickness of a paper sheet as measured under specified conditions relevant to the paper product.

CD—cross machine direction, with particular reference to the orientation of yarns of a papermaking fabric when installed on a papermaking machine.

Center Plane Resistance (CPR)—refers to the retardation of drainage caused by the presence of long internal warp or weft floats which restrict the drainage area of the center plane of the fabric.

MD—machine direction, with particular reference to the orientation of yarns of a papermaking fabric when installed on a papermaking machine.

MS—machine contact side of the papermaking or TAD fabric on a papermaking machine.

Pocket Yarn—a weft yarn whose vertical dimension is between about 30% and 60% that of the primary weft yarn. The pocket yarns are used to form the "floor" of depressions in the PS surface of the fabric so as to support papermaking fibers; they are also interwoven with the warp yarns in a manner that contributes to the CPR of the fabric.

PS—paper sheet forming or support side of a papermaking or TAD fabric as used on a papermaking machine.

Surface Area—the total area of one exterior surface of a paper sheet, including its surface contours.

Topography—a description of the three dimensional undulations and contours of a surface. A sheet surface having a "higher" surface topography has more surface contours, which can be of a greater magnitude, than another surface having fewer contours of a lesser magnitude when measured under similar conditions.

Vertical Dimension (of a yarn)—refers to the measurement of a yarn in the direction which will be substantially perpendicular to the paper side surface of the fabric when woven.

Figure 2:
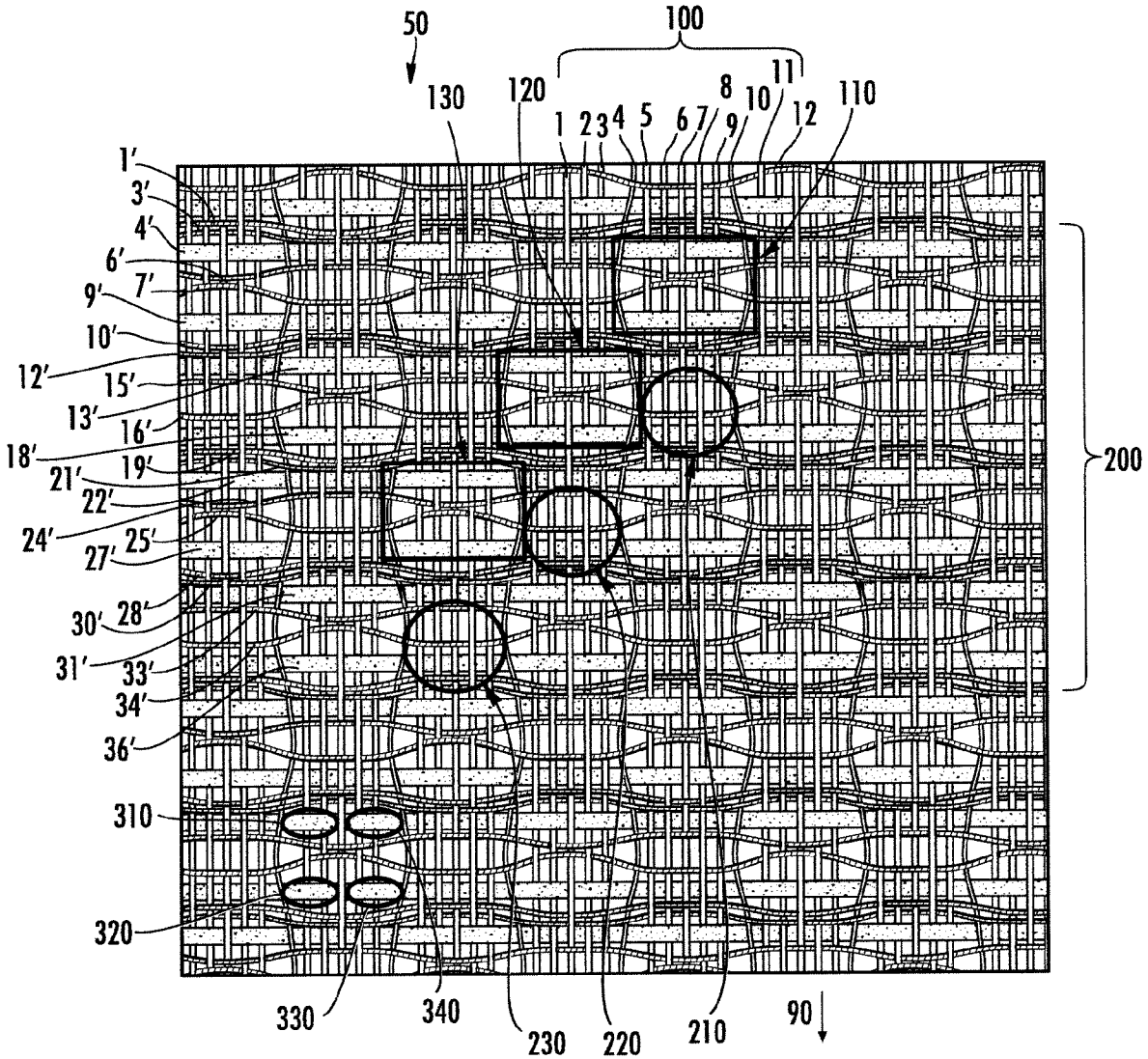
FIG. 2 is a line drawing of the paper side surface of a fabric woven according to the weave pattern shown in FIG. 1.

Yarn—any monofilament, multi-filament, cabled or other type of fiber strand used in weaving a papermaking or TAD fabric Referring to FIGS. 1-3, a first preferred embodiment of a papermaker's or TAD fabric 50 in accordance with the present invention is shown. The fabric 50 is formed of one or more systems of warp yarns 100 and at least first and second systems of weft yarns 200. The weft yarns 200 of the at least first and second systems of weft yarns 200 are of at least two differing sizes and each system is woven according to differing patterns in the paper side surface.

The warp yarns 100 are labeled across the top of the FIGS. 1 and 2 from 1 to 12. The weft yarns 200 are labeled from 1' to 36' along the left side of the weave diagram of FIG. 1 and the fabric of FIG. 2. Twelve weft yarns 2', 5', 8', 11', 14', 17', 20', 23', 26', 29', 32' and 35' are located on the machine side surface of the fabric and thus appear only in FIG. 3 (as do warp yarns 13 through 24) because FIG. 3 is a weave diagram of one complete repeat of the entire fabric including both the machine and paper side layers. These latter warp and weft yarns form the machine side surface of the fabric and provide a stable platform for the paper side layer of the fabric. In the weave diagrams, a darkened square occurs where a weft yarn passes under a warp yarn so that, for example, weft 3' passes under warp 1, over warps 2 & 3, under warps 4 through 10, and then over warps 11 and 12 to complete the paper side layer repeat.

The fabric 50 of the first preferred embodiment is an intrinsic weft tie SSB type composite forming fabric in which the weft yarns 200 forming the paper side (PS) layer are arranged so as to enhance the uniformity, caliper and topography of paper products formed thereon. The fabric 50 includes two sets of warp yarns 100, the first located on the PS surface and numbered 1-12 in FIGS. 1-3, and the second located on the machine side (MS) surface of the fabric and numbered 13-24 in FIG. 3. In the fabric shown in FIGS. 1-3, 16 of the PS weft yarns 1', 3', 6', 7', 10', 12', 15', 16', 19', 21', 24', 25', 28', 30', 33' and 34' all have a smaller vertical dimension than 8 of the PS weft yarns 4', 9', 13', 18', 22', 27', 31' and 36', and are thus "pocket" yarns. The weft yarns 4', 9', 13', 18', 22', 27', 31' and 36' have a relatively greater vertical dimension and will be referred to as Caliper and Topography Augmenting or CTA yarns.

The first system of weft yarns includes the CTA yarns 4', 9', 13', 18', 22', 27', 31' and 36' which are larger (have a greater vertical dimension) than the pocket weft yarns 1', 3', 6', 7', 10', 12', 15', 16', 19', 21', 24', 25', 28', 30', 33' and 34' of the second weft system. This first system of CTA weft yarns 4', 9'; 13', 18'; 22', 27'; 31', 36' is arranged as pairs of intrinsic weft binder yarns that are interwoven with the two sets of warp yarns 1-12, 13-24 so that each weft binder yarn pair member 4', 9'; 13', 18'; 22', 27'; 31', 36' interweaves with the PS warp yarns 1-12 to form two PS layer weft yarn floats, and then interlaces once with the MS warp yarn 13-24 in each repeat of the weave to form and bind the machine and paper side layers of the fabric 50 together. The PS floats of the intrinsic weft binder yarns 4', 9', 13', 18', 22', 27', 31' and 36' (indicated by diagonal lines in FIG. 1) are arranged in identical pairs so that, in the longitudinal direction of the fabric 50, two identical first weft system CTA yarn floats follow one another so as to form a box-shaped support areas 110, 120, 130 having a first height above the fabric plane.

As shown in FIG. 1, the pairs of adjacent CTA weft yarns 4', 9'; 13', 18'; 22', 27'; 31', 36' of the first system form groupings of fiber support knuckles that are arranged to form 4-cornered box-shaped support areas (or boxes) 110, 120, 130 with each first system CTA weft yarn 4', 9', 13', 18', 22', 27', 31' and 36' forming two sets of knuckles (or floats) in the CD (which have been marked with diagonal lines in FIG. 1 for emphasis). The two sets of floats of one CTA yarn (for example weft yarn 4' at box 110 in FIG. 2) are located in line with a corresponding set of floats on an adjacent CTA yarn (for example weft yarn 9' at box 110 in FIG. 2) to form the four corners of the box 110. The rectangles 110, 120 and 130 represent some of the boxes defined by the CTA weft yarn floats located at each of their four corners. For example, the four corners of box 110 are formed by the floats created where weft yarn 4' passes over warp 5 & 6 and 8 & 9, and where weft 9' passes over the same warp yarns. These box corners are indicated in FIG. 2 at 310, 320, 330 and 340, which locations are merely exemplary of the arrangement in the fabric 50.

The box-shaped knuckle arrangements 110, 120, 130 create a corresponding set of low fiber density protrusions in the sheet formed on the fabric 50. Both CTA weft yarns 4' and 9' have a greater vertical dimension than the surrounding pocket yarns and therefore the corners of box 110, for example, will be elevated above the fabric plane in comparison to the pockets formed by the pocket yarns. Note also that the "floor" or interior of box 110 includes pocket yarns 6' and 7' and thus the floor is recessed below the plane formed by the floats e.g. 310 to 340

The two adjacent first system yarns 4', 9'; 13', 18'; 22', 27'; 31', 36' are separated in the machine direction of the fabric by at least one fiber retaining pocket yarn 1', 3', 6', 7', 10', 12', 15', 16', 19', 21', 24', 25', 28', 30', 33' and 34' of the second weft yarn system. The pocket yarns 1', 3', 6', 7', 10', 12', 15', 16', 19', 21', 24', 25', 28', 30', 33' and 34' are interwoven with the warp yarns 100 to form both the "bottom" of the boxes 110, 120, 130 as well as the "bottom" of adjacent pockets 210, 220, 230 located between the boxes 110, 120, 130 and assist in retaining the papermaking fibers on the surface of the fabric 50. These pockets 210, 220, 230 form higher fiber density depressions in the sheet which, together with the protrusions, contribute to its overall caliper and topography, and hence sheet bulk. The number of pocket yarns 1', 3', 6', 7', 10', 12', 15', 16', 19', 21', 24', 25', 28', 30', 33' and 34' between adjacent boxes 110, 120, 130, as well as the number of pocket yarns 1', 3', 6', 7', 10', 12', 15', 16', 19', 21', 24', 25', 28', 30', 33' and 34' within each individual box, can be varied so that both box size and spacing can be modified in response to papermaking requirements.

In the first preferred embodiment, eight second system weft yarns 6', 7', 15', 16', 24', 25', 33' and 34', each having a diameter that is less than that of the CTA weft binder yarns, are interwoven with the PS warp yarns 1-12 only, and are arranged so that two of these smaller yarns are located in between each paired set of intrinsic CTA weft binder yarns of the first weft yarn system. Eight smaller diameter second system weft yarns 1', 3', 10', 12', 19', 21', 28' and 30' are arranged around the box-like support areas 110, 120, 130 in the PS surface so as to form support areas having a second height which is lower than the first. These smaller diameter weft yarns 1', 3', 6', 7', 10', 12', 15', 16', 19', 21', 24', 25', 28', 30', 33' and 34' are also interwoven between the PS and MS layers of warp yarns so as to contribute to the center plane resistance of the fabric, and thus retard, to some extent, drainage through them. This assists in providing a more uniform and better formed sheet.

For a multi-layer fabric 50 as shown, preferably a third system of weft yarns 2', 5', 8', 11', 14', 17', 20', 23', 26', 29', 32' and 35' are located on the machine side surface of the fabric only and thus appear only in FIG. 3 (as do warp yarns 13 through 24) because FIG. 3 is a weave diagram of one complete repeat of the entire fabric including both the machine and paper side layers.

The fabric 50 whose PS surface has been constructed in accordance with the above description has been woven and its representation is provided in FIG. 2. This is an intrinsic weft type forming fabric (so-called SSB type). However, it will be understood that the invention is not limited to any one specific fabric type, and can be used with various fabrics such as those described in "Weaves of Papermaking Wires and Forming Fabrics," PAPTAC [Pulp & Paper Technical Association of Canada] Data Sheet G-18, revised May 2005. The use of a box-like arrangement of the larger sized weft yarn knuckles or floats 310, 320, 330, 340 and the smaller sized pocket yarns 1', 3', 6', 7', 10', 12', 15', 16', 19', 21', 24', 25', 28', 30', 33' and 34' to form the bottom of the box as well as the bottom of the adjacent pockets, is easily transported to other fabric types, such as triple layer, double layer or extra support double layer and single layer fabrics.

It is noted that FIG. 1 and FIG. 2 show ovals representing pockets 210, 220, 230 which appear immediately below the boxes 110 and 120 respectively. These pockets are in fact above, below, and to either side of each box 110, 120, 130 so that each box 110, 120, 130 is surrounded by pockets 210, 220, 230. As can be seen by reference to FIG. 2, the paper side surface of the fabric in these areas is populated by the pocket yarns only, and thus these areas 210, 220, 230 would represent the pockets in the paper side surface formed by the pocket yarns. The above features are more easily seen with reference to FIG. 2 in which like elements from FIG. 1 have been provided with corresponding labels.

As previously discussed in relation to FIG. 1, weft yarns 1', 3', 6', 7', 10', 12', 15', 16', 19', 21', 24', 25', 28', 30', 33' and 34' all have a smaller vertical dimension than the weft yarns 4', 9', 13', 18', 22', 27', 31' and 36'; examination of FIG. 2 shows this feature readily as these smaller pocket yarns are black and the larger CTA yarns are white.

Further examination of FIG. 2 shows that all of the boxes 110, 120 and 130 are arranged diagonally, and that pocket areas 210 and 220 (for example) immediately follow each box in the machine direction 70 and are also arranged diagonally, parallel with the boxes so that each elevated box is surrounded by a pocket depression areas. Each box (for example 110) is separated from the next box (for example 120) in the machine direction 90 by 2 pocket yarns, e.g. 10' and 12'. It will be apparent that the number of pocket yarns separating one box 110 from the next 120 in the machine direction 90 can be adjusted according to the prevailing papermaking conditions and the physical properties desired for the paper product to be formed or conveyed by the fabric (i.e. the spacing of the boxes and pockets from one another can be varied as needed).

It will also be appreciated that the size of the boxes can be adjusted in both the machine and cross-machine directions to suit papermaking requirements, as can the knuckle size. For example, although FIGS. 1-3 show two pocket yarns e.g. 6' and 7' on the "floor" of box 110, there could be more or less, and preferably, the pocket yarns on the floor range from 1 to 6; similarly the number of pocket yarns between boxes can range from 1 to 6; also, the number of warp yarns e.g. 5, 6, 7, 8 & 9 (5 yarns) dictating the CD width of the boxes (for these warp yarns, box 110) can be adjusted according to need. Preferably, the number of warp yarns is in the range of 3 (the weft follows an over 1, under 1, over 1 path) to 8 (over 2, under 4, over 2), but other designs are possible.

A further feature of this invention is the use of at least one of the pocket yarns as a center plane resistance or "CPR" yarn. This blocks straight-through drainage of fluid by creating a measure of resistance in the fabric which helps to retard immediate removal of fluid and thus improve uniformity of formation (i.e. the papermaking fibers are not "set" quite so quickly). In the case of the first preferred embodiment of the fabric, every $4^{th}$ pocket yarn is used as a CPR yarn 3', 12', 21', 30' and its path resides in between the PS and MS layers more than it does on the paper side surface.

In the first preferred embodiment, the warp yarns are 0.15 mm diameter, pocket weft yarns are 0.13 mm in diameter, the CTA weft yarns are 0.28 mm, and the MS weft are 0.20 mm in diameter; all of the yarns are round. Other sizes of yarns can be utilized. The mesh is 76×86/52 (i.e. 76 warp/in PS [29.9 yarns/cm] and MS with 86 weft/in PS [33.9 yarns/cm] and 52 weft/in MS [20.5 yarns/cm] and thus has a 3:2 weft ratio; this is not critical and the ratio could be higher at 2:1 or 3:1 or lower at 1:1). The fabric will ideally have an air permeability of about 300-650 cfm (cubic feet per minute per square foot of fabric) for tissue forming applications, and 400-1000 cfm for TAD applications.

The CTA weft yarns 4', 9', 13', 18', 22', 27', 31' and 36' and the pocket weft yarns 1', 3', 6', 7', 10', 12', 15', 16', 19', 21', 24', 25', 28', 30', 33' and 34' can be of any desired cross-sectional shape. The current embodiment shows round yarns, but other shapes are possible. In multilayer fabrics, the CTA weft yarns 4', 9', 13', 18', 22', 27', 31' and 36' also serve to lock the two layers together tightly. In all fabrics, the CTA yarns 4', 9', 13', 18', 22', 27', 31' and 36' provide the wear plane on the MS and because of its relatively larger size offers good wear life. Polymer materials used in the production of these fabrics will be those commonly used in the industry for similar applications, and may include for example, polyamides such as polyamide 6/6, polyesters such as polyethylene terephthalate (PET), polybutylene terephthalate (PBT), polyethylene naphthalate (PEN) or any other suitable polymers or blends thereof including polyurethane and PET such as are described in U.S. Pat. No. 5,502,120. The warp yarns can similarly be round, flat or other shapes.

Figure 4A:
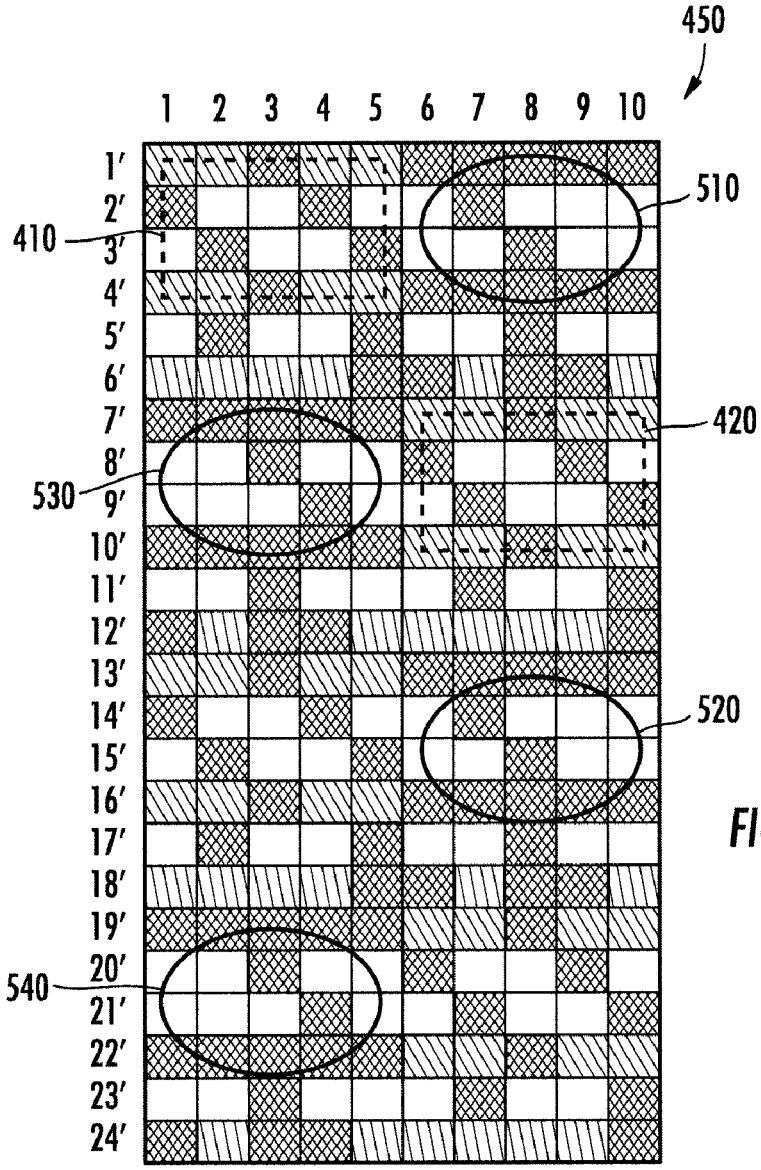
FIG. 4*a* is the weave diagram of a single layer fabric according to a second embodiment of the invention.

FIG. 4*a* is a weave diagram of a 10-shed single layer fabric 450 in accordance with a second preferred embodiment that utilizes the teachings of this invention. In this figure, the CTA weft yarns 1', 4', 7', 10', 13', 16', 19' and 22' of the first system of weft yarns interlace with the warp yarns to form fiber support knuckles arranged at the four corners of a box as shown for example at 410 and 420. Because the CTA weft yarns 1', 4', 7', 10', 13', 16', 19' and 22' have a larger vertical dimension than the weft yarns of the second system of pocket weft yarns 2', 3', 5', 6', 8', 9', 11', 12', 14', 15', 17', 18', 20', 21', 23' and 24', pockets are formed in the fabric as illustrated, for example, at 510, 520, 530 and 540. Weft yarns 6', 12', 18' and 24' are interwoven with a portion of the warp yarns (in this case 50%) so as to pass beneath them (e.g. weft 6' passes under warps 1-4, over 5 & 6, under 7, over 8 & 9 and under 10) while being recessed from the wear plane by the larger CTA weft yarns. In this location, and with this plan of interweaving, these weft yarns serve the function of partially restricting drainage through this single layer structure and thus serve to enhance fabric CPR.

Figure 4B:
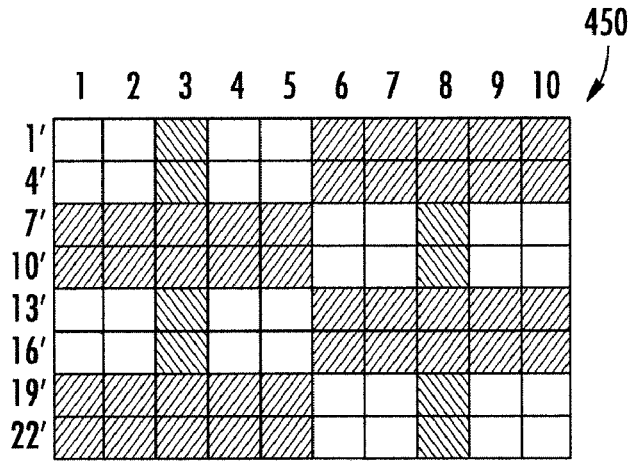
FIG. 4*b* is a weave diagram showing the machine side surface of the fabric depicted in FIG. 4*a*.

FIG. 4*b* is a weave diagram showing the machine side surface of the fabric 450 (i.e. only those weft yarns that actually form the wear plane of the fabric). It can be seen that only the CTA weft yarns 1', 4', 7', 10', 13', 16', 19' and 22' pass down to this surface of the fabric and form long MS knuckles as they "float" over warp 5. For example, weft 1' floats over warps 6-10 to provide a wear plane which, along with the other CTA weft yarns 4', 7', 10', 13', 16', 19' and 22' will be in contact with the various stationary elements over which the fabric will pass.

The yarn dimensions and materials of the second preferred embodiment of the fabric 450 shown in FIG. 4 would be similar to those used in the fabric of FIGS. 1-3. FIG. 4 is provided to show that it is possible to create a single layer fabric in accordance with the teachings of the present invention. Such a fabric may be preferred for use as a TAD fabric because of its relatively more open structure, and thus higher air permeability, as compared to the fabric of FIGS. 1-3.

While two preferred embodiments of fabrics according to the invention have been disclosed in detail, the invention is not limited to these preferred embodiments, and encompasses TAD and papermaking fabrics having the configuration of boxes and pockets as recited in the claims.

I claim:

1. A papermaker's fabric comprising at least one system of warp yarns interwoven with at least first and second systems of weft yarns, the weft yarns of the first system of weft yarns having a vertical dimension that is greater than a vertical dimension of the weft yarns of the second system, the fabric having a papermaking surface and a machine side surface, wherein in the papermaking surface:

a) the yarns of the first system of weft yarns are interwoven with the warp yarns to provide groups of four weft yarn floats which form four corners of a box shape on the papermaking surface;

b) the yarns of the second system of weft yarns are interwoven with the warp yarns so as to pass through the bottom of the box shape, and further provide support areas in pockets located adjacent to the box shapes;

c) at least one yarn from the second system of weft yarns interweaves with the warp yarns to occupy space in a center plane of the fabric so as to restrict or retard drainage and thereby increase a center plane resistance of the fabric.

2. A fabric according to claim 1, wherein the fabric is one of a composite SSB fabric, a warp tie fabric, a double layer extra support fabric, a double layer fabric, a semi duplex or a single layer fabric.

3. A fabric according to claim 1, wherein the fabric is a warp tie fabric.

4. A fabric according to claim 1, wherein a number of warp yarns between each knuckle ranges from 1 to 4.

5. A fabric according to claim 1, wherein a number of the pocket yarns between each of the yarns of the first system of weft yarns is from 1 to 6.

6. A fabric according to claim 1, wherein a number of the yarns of the second weft system located between the weft yarn floats of adjacent non-paired ones of the first system of weft yarns is different from a number of the yarns of the second weft system located between pairs of adjacent ones of the weft yarns of the first system of weft yarns that form the box shape.

7. A fabric according to claim 1, wherein the fabric comprises a forming fabric.

8. A fabric according to claim 1, wherein the fabric comprises a TAD fabric.

9. A fabric according to claim 1, wherein the vertical dimension of the yarns of the first system of weft yarns is at least 1.25 times greater than the vertical dimension of the yarns of the second system of weft yarns.

10. A fabric according to claim 1, wherein the weft yarns of the first system of weft yarns are arranged in adjacent pairs that are separated from one another by the yarns from the second system weft yarns, and the pairs of first system weft yarns are interwoven with the warp yarns on a paper support side of the fabric so that aligned pairs of the weft yarn floats which form the four corners of the box shape are formed over the same warp yarns.

11. A fabric according to claim 1, wherein the at least one system of warp yarns comprises first and second systems of warp yarns, the first system of warp yarns interweaves with the first system of weft yarns on a paper support side of the fabric, the second system of weft yarns only interweaves with the first system of warp yarns on the paper side surface of the fabric, and the second system of warp yarns is located on a machine side surface of the fabric, and the weft yarns of the first system of weft yarns interweave with the second system of warp yarns.

12. A fabric according to claim 11, further comprising a third system of weft yarns that only interweaves with the second system of warp yarns.

* * * * *